US008571437B2

(12) United States Patent
Hirasawa et al.

(10) Patent No.: US 8,571,437 B2
(45) Date of Patent: Oct. 29, 2013

(54) COOLING DEVICE AND IMAGE FORMING APPARATUS

(75) Inventors: Tomoyasu Hirasawa, Kanagawa (JP); Satoshi Okano, Kanagawa (JP); Masanori Saitoh, Tokyo (JP); Shingo Suzuki, Kanagawa (JP); Kenichi Takehara, Kanagawa (JP); Yasuaki Iijima, Kanagawa (JP); Hiromitsu Fujiya, Kanagawa (JP); Keisuke Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/926,988

(22) Filed: Dec. 22, 2010

(65) Prior Publication Data

US 2011/0164896 A1 Jul. 7, 2011

(30) Foreign Application Priority Data

Jan. 6, 2010 (JP) ..... 2010-001121
Sep. 13, 2010 (JP) ..... 2010-203951

(51) Int. Cl.
*G03G 21/20* (2006.01)

(52) U.S. Cl.
USPC ..... 399/94; 399/91; 165/104.33; 165/104.34; 361/699

(58) Field of Classification Search
USPC ..... 399/91, 94; 165/65, 80.2, 104.31, 165/104.28, 104.33, 104.34, 104.65; 361/699
See application file for complete search history.

(56) References Cited

U.S. PATENT DOCUMENTS

| | | | | |
|---|---|---|---|---|
| 2005/0063157 | A1 * | 3/2005 | Tustaniwskyi et al. | 361/699 |
| 2005/0243517 | A1 * | 11/2005 | Malone et al. | 361/699 |
| 2008/0024988 | A1 * | 1/2008 | Suzuki et al. | 361/699 |
| 2008/0101023 | A1 * | 5/2008 | Hsu | 361/699 |
| 2008/0101024 | A1 * | 5/2008 | Lu et al. | 361/699 |
| 2009/0269099 | A1 * | 10/2009 | Takehara | 399/94 |
| 2010/0008694 | A1 * | 1/2010 | Okano et al. | 399/94 |
| 2010/0008695 | A1 * | 1/2010 | Okano et al. | 399/94 |

FOREIGN PATENT DOCUMENTS

| | | |
|---|---|---|
| JP | 07-035453 | 2/1995 |
| JP | 2005-164927 A | 6/2005 |
| JP | 2006-201597 A | 8/2006 |
| JP | 2007-024985 A | 2/2007 |
| JP | 2008-180831 A | 8/2008 |

* cited by examiner

*Primary Examiner* — David Gray
*Assistant Examiner* — Francis Gray
(74) *Attorney, Agent, or Firm* — Harness, Dickey, & Pierce, P.L.C.

(57) ABSTRACT

A cooling device includes a heat receiving unit disposed to contact a surface of a temperature-increasing part the temperature of which increases during an image forming process; a radiation unit transferring heat from a cooling liquid; a tube for circulating the cooling liquid between the heat receiving unit and the radiation unit in a liquid circulation direction; a conveying unit conveying the cooling liquid through the tube; a coupling having an internal flow path and including a first end to which a first part of the tube is connected and a second end to which a second part of the tube is connected; and an outlet for draining the cooling liquid from the tube. At least one of the first part of the tube and the second part of the tube extends to a position lower than the position of the coupling.

8 Claims, 12 Drawing Sheets

COOLING DEVICE AND IMAGE FORMING APPARATUS

BACKGROUND OF THE INVENTION

1. Field of the Invention

A certain aspect of this disclosure relates to a cooling device and an image forming apparatus including the cooling device.

2. Description of the Related Art

An image forming apparatus such as a printer, a facsimile machine, or a copier normally includes an optical unit, a scanning unit, a fusing unit, and a developing unit that generate heat, and the generated heat increases the temperature in the image forming apparatus.

For example, when a developer agitating/conveying part of the developing unit is driven to agitate and convey a developer in the developing unit, the temperature in the developing unit is increased due to frictional heat generated by friction between the developer and the developer agitating/conveying part and friction among developer particles. Frictional heat is also generated by friction between a developer and a developer-thickness limiting part that limits the thickness of a layer of the developer on a developer carrier before the developer is conveyed to a developing area. Further, when the layer of the developer is scraped by the developer-thickness limiting part, frictional heat is generated by friction among developer particles. Accordingly, such frictional heat also increases the temperature in the developing unit.

The increased temperature may cause toner in the developer to melt and stick to the developer-thickness limiting part, the developer carrier, and an image carrier; and the sticking toner may cause an image error such as an undesired white line in an image. Also, when stress such as pressure or frictional force is applied to heated toner, an external additive on the toner surface may be buried in the toner or removed from the toner surface and as a result, the toner may harden on the carrier. Over time, the above problems may degrade the performance of the developing unit. Particularly, when toner with a low melting temperature is used to reduce the energy necessary for fusing, image errors may easily occur due to sticking and hardening of toner.

In a known image forming apparatus, external air is drawn into the image forming apparatus with an air-cooling fan and conveyed via a duct to an area near the developing unit to generate an air current and thereby to cool the developing unit. This configuration makes it possible to prevent the temperature of the developing unit from increasing excessively. However, with a recent downsized, densely-packed image forming apparatus, it is difficult to secure a space around a developing unit to install a duct for circulating air from a cooling fan to cool the developing unit.

Meanwhile, Japanese Patent Application Publication No. 2005-164927 discloses an image forming apparatus including a liquid-cooling device that circulates a liquid to cool a developing unit. The disclosed liquid-cooling device includes a heat-receiving part that is in contact with a surface of the developing unit so that a cooling liquid can receive heat from the developing unit; a radiation unit for transferring heat from the cooling liquid; a tube laid out such that the cooling liquid circulates between the heat-receiving part and the radiation unit, and a conveying unit for conveying the cooling liquid through the tube. Generally, a liquid-cooling device can cool a developing unit more efficiently than an air-cooling device. Also, since the cross section of a tube for circulating a cooling liquid is generally smaller than the cross section of a duct for circulating cooling air, the tube for circulating a cooling liquid can be laid out around a developing unit even when only a small space is available around the developing unit. Thus, a liquid-cooling device can be used to cool a developing unit even in a densely-packed image forming apparatus.

As described above, an image forming apparatus includes components (hereafter called temperature-increasing parts), such as an optical unit, a scanning unit, a fusing unit, and a developing unit, the temperatures of which increase during an image forming process. Such temperature-increasing parts are present in various parts of an image forming apparatus, and a liquid-cooling device is preferably used to cool the temperature-increasing parts. When using a liquid-cooling device for a densely-packed image forming apparatus where only small space is available, it is necessary to lay out a tube in a complex pattern through the small space and provide heat-receiving parts for respective temperature-increasing parts. Therefore, when installing or removing a liquid-cooling device in or from an image forming apparatus, it is necessary to separate the tube of the liquid-cooling device into parts. When separating a tube containing a cooling liquid into parts, it is preferable to completely drain the cooling liquid from the tube to prevent the cooling liquid from spilling out of the tube. However, a tube laid out in a complex pattern in an image forming apparatus includes parts, such as U-shaped parts, where the cooling liquid tends to remain, and therefore it is difficult to completely drain the cooling liquid from the tube. Accordingly, if the tube is separated at positions where the cooling liquid tends to remain, a large amount of the cooling liquid spills out of the tube and wets the interior of the image forming apparatus and the floor.

SUMMARY OF THE INVENTION

In an aspect of this disclosure, there is provided a cooling device that includes a heat receiving unit disposed to contact a surface of a temperature-increasing part the temperature of which increases during an image forming process; a radiation unit transferring heat from a cooling liquid; a tube for circulating the cooling liquid between the heat receiving unit and the radiation unit in a liquid circulation direction; a conveying unit conveying the cooling liquid through the tube; a coupling having an internal flow path and including a first end to which a first part of the tube is connected and a second end to which a second part of the tube is connected; and an outlet for draining the cooling liquid from the tube. At least one of the first part of the tube and the second part of the tube extends to a position lower than the position of the coupling.

DESCRIPTION OF THE PREFERRED EMBODIMENTS

Preferred embodiments of the present invention are described below with reference to the accompanying drawings.

An image forming apparatus according to an embodiment of the present invention is described below.

Figure 2:
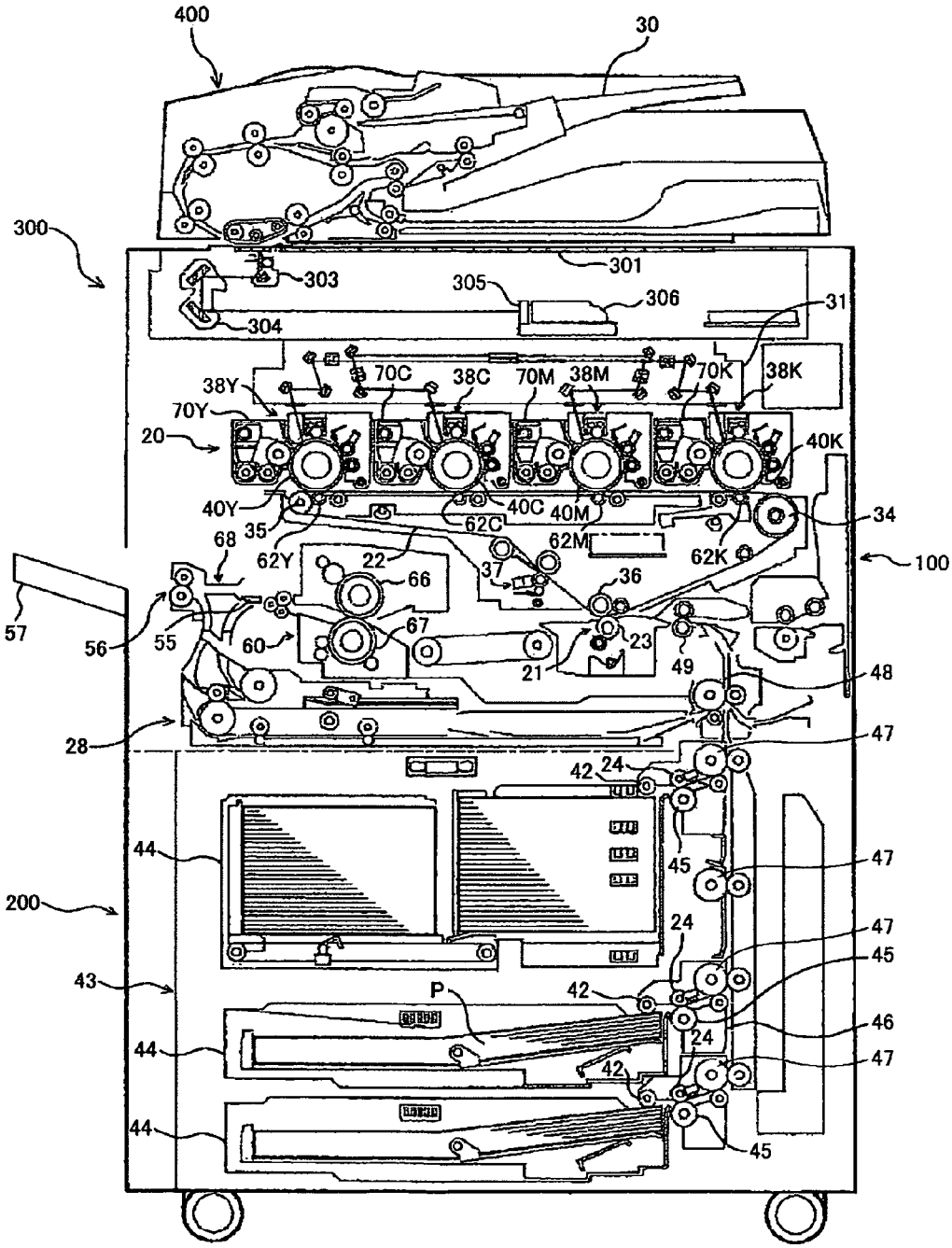
FIG. 2 is a schematic diagram of an image forming apparatus according to an embodiment of the present invention.

FIG. 2 is a schematic diagram of an image forming apparatus of this embodiment. The image forming apparatus includes a main unit 100, a paper-feed table 200 on which the main unit 100 is mounted, a scanner 300 mounted on the main unit 100, and an automatic document feeder (ADF) 400 mounted on the scanner 300.

The scanner 300 includes a first moving unit 303 including a light source for illuminating a document and a mirror, and a second moving unit 304 including reflection mirrors. The first moving unit 303 and the second moving unit 304 are moved back and forth by a motor (not shown) to scan a document placed on a contact glass 301. A scanning beam from the second moving unit 304 is focused by an imaging lens 305 on an imaging surface of a scanning sensor 306 behind the imaging lens 305. The scanning sensor 306 converts the scanning beam into an image signal.

The main unit 100 includes photosensitive drums 40Y, 40C, 40M, and 40K that are used as latent image carriers and correspond to yellow (Y), cyan (C), magenta (M), and black (K) toner images. Components such as a charging unit, a developing unit, and a cleaning unit used for an electrophotographic process are disposed around each of the photosensitive drums 40. Each combination of the components and one of the photosensitive drums 40 constitutes an image forming unit 38. Four image forming units 38Y, 38C, 38M, and 38K constitute a tandem image forming unit 20.

Developing units 70Y, 70C, 70M, and 70K of the image forming units 38 use developers including toners of the corresponding colors. Each of the developing units 70 includes a developing sleeve used as a developer carrier for carrying the developer. An alternating electric field is applied to the developing sleeve at a position facing the corresponding photosensitive drum 40 to develop a latent image on the photosensitive drum 40 with the toner. The applied alternating electric field activates the developer, narrows the charge distribution of the toner, and thereby improves the development performance. The developing unit 70 and the photosensitive drum 40 may be integrated as a process cartridge that is attachable to and detachable from the main unit 100. This configuration makes it possible to easily attach or detach the developing unit 70 and the photosensitive drum 40 to or from the main unit 100 and thereby to improve the maintenance efficiency. The process cartridge may also include a charging unit and a cleaning unit.

An exposing unit 31 is provided above the tandem image forming unit 20. The exposing unit 31 forms latent images by exposing the photosensitive drums 40 with laser beams or LED light according to image data.

An intermediate transfer belt 22, which is an endless belt, is disposed below the tandem image forming unit 20 so as to face the photosensitive drums 40. The intermediate transfer belt 22 is supported by support rollers 34, 35, and 36. Primary transfer units 62Y, 62C, 62M, and 62K are provided at positions facing the corresponding photosensitive drums 40 via the intermediate transfer belt 22. The primary transfer units 62 transfer toner images of the respective colors from the photosensitive drums 40 onto the intermediate transfer belt 22.

Also, a secondary transfer unit 21 is disposed below the intermediate transfer belt 22. The secondary transfer unit 21 transfers the toner images superposed on the surface of the intermediate transfer belt 22 onto paper P fed from one of paper-feed cassettes 44 of the paper-feed table 200. The secondary transfer unit 21 includes a secondary transfer roller 23 and a roller moving mechanism (not shown) for movably supporting the secondary transfer roller 23. The roller moving mechanism brings the secondary transfer roller 23 into contact with the intermediate transfer belt 22 or moves the secondary transfer roller 23 away from the intermediate transfer belt 22. The secondary transfer unit 21 presses the secondary transfer roller 23 via the intermediate transfer belt 22 against the support roller 36 and thereby transfers the toner images from the intermediate transfer belt 22 onto the paper P. Hereafter, the support roller 36 may be called secondary transfer backup roller 36.

An intermediate transfer belt cleaning unit 37 is provided to remove toner remaining on the surface of the intermediate transfer belt 22. For example, the intermediate transfer belt cleaning unit 37 includes a fur brush or a cleaning blade made of polyurethane rubber which is in contact with the intermediate transfer belt 22 and scrapes off the remaining toner on the intermediate transfer belt 22.

A fusing unit 60 provided near the secondary transfer unit 21 fuses the toner images onto the paper P. The fusing unit 60 includes a heating roller 66 including a heater and a pressure roller 67 for pressing the paper P against the heating roller 66.

A reversing unit 28 for turning the paper P upside down is provided below the secondary transfer unit 21 and the fusing unit 60. The reversing unit 28 turns the paper P upside down when images are to be recorded on both sides of the paper P.

Next, operations of the image forming apparatus are described.

A document is placed on a document table 30 of the automatic document feeder 400; or the automatic document feeder 400 is opened, a document is placed on the contact glass 301 of the scanner 300, and the automatic document feeder 400 is closed. When the document is placed on the document table 30 and a start switch is pressed, the document is automatically conveyed onto the contact glass 301 and then the scanner 300 is started. Meanwhile, when the document is placed on the contact glass 301 and the start switch is pressed, the scanner 300 is immediately started. When the scanner 300 is started, the first moving unit 303 and the second moving unit 304 are moved to scan the document. More specifically, light is emitted from the light source of the first moving unit 303 to the document surface and reflected light from the document surface is reflected by the mirror of the first moving unit 303 toward the second moving unit 304. Next, the light is further reflected by the mirrors of the second moving unit 304, goes through the imaging lens 305, and enters the scanning sensor 306. Then, the scanning sensor 306 converts the entered light into an image signal.

When the start switch is pressed, a drive motor is also started to rotate one of the support rollers 34, 35, and 36 and thereby to rotate the intermediate transfer belt 22 (the other two support rollers are also rotated by the rotation of the intermediate transfer belt 22). At substantially the same time, in each of the image forming units 38, the photosensitive drum 40 is uniformly charged by the charging unit. Then, the charged photosensitive drum 40 is illuminated by a laser beam or LED light from the exposing unit 31 according to the image signal obtained by the scanner 300 to form an electrostatic latent image on the photosensitive drum 40. Toner is supplied from the developing unit 70 to the photosensitive drum 40, on which the electrostatic latent image has been formed, to visualize (or develop) the electrostatic latent image. As a result, single-color images (toner images) of yellow (Y), cyan (C), magenta (M), and black (K) are formed on the photosensitive drums 40. The single-color images are transferred (primary transfer) sequentially by the primary transfer units 62 onto the intermediate transfer belt 22 such that the single-color images are superposed and form a multicolor toner image on the intermediate transfer belt 22. After the single-color images are transferred, remaining toner on the photosensitive drums 40 is removed by photosensitive drum cleaning units and the photosensitive drums 40 are discharged by discharging units (not shown) to prepare for the next image forming process.

Also when the start switch is pressed, one of paper-feed rollers 42 of the paper-feed table 200 is rotated to feed the paper P from the corresponding one of the paper-feed cassettes 44. Sheets of the paper P are separated by a separating roller 45 and fed one by one into a paper-feed path 46. Then, the paper P is conveyed by conveying rollers 47 into a paper-feed path 48 of the main unit 100 and is stopped at a resist roller 49. The resist roller 49 is rotated in synchronization with the movement of the multicolor toner image on the intermediate transfer belt 22 to feed the paper P into a gap between the intermediate transfer belt 22 and the secondary transfer unit 21 and to transfer the multicolor toner image onto the paper P.

After passing through the secondary transfer roller 23, the paper P with the multicolor toner image is fed into the fusing unit 60 where the multicolor toner image is fused onto the paper P by heat and pressure and thereby converted into a permanent image. The paper P with the permanent image is guided by a switching claw 55 to an ejection roller pair 56 and ejected by the ejection roller pair 56 onto a paper-catch tray 57. Meanwhile, when an image is to be formed also on the back side of the paper P, the paper P is guided by the switching claw 55 into the reversing unit 28, turned upside down and conveyed to a transfer position again to form an image on the back side, and then ejected by the ejection roller pair 56 onto the paper-catch tray 57. In the above process, after the multicolor toner image is transferred from the intermediate transfer belt 22, toner remaining on the intermediate transfer belt 22 is removed by the intermediate transfer belt cleaning unit 37 to prepare for the next image forming process by the tandem image forming unit 20.

Figure 3:
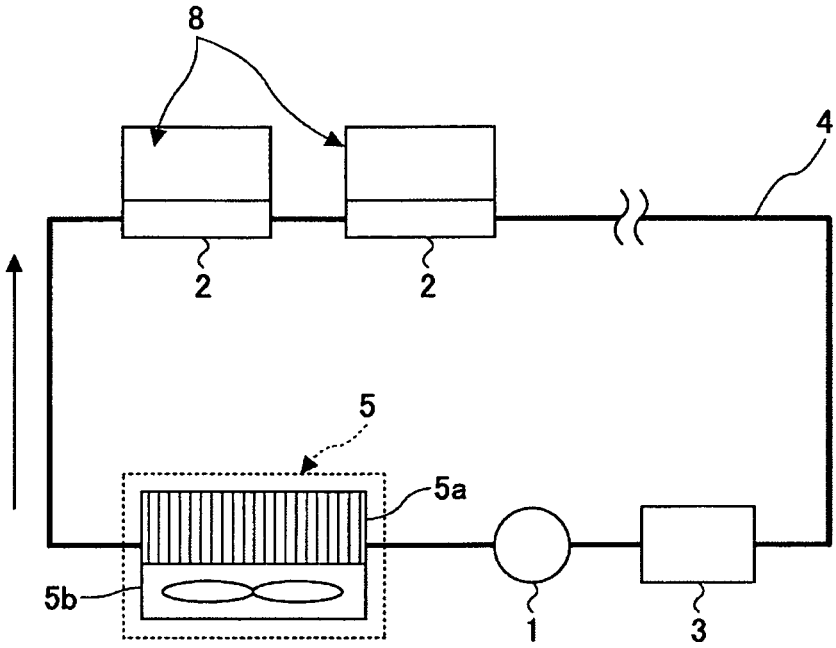
FIG. 3 is a schematic diagram of a liquid-cooling device.

FIG. 3 is a schematic diagram of a liquid-cooling device 10 (hereafter simply called a cooling device 10). As shown in FIG. 3, the cooling device 10 includes a tube 4; a radiation unit 5 including a radiator 5*a* and a cooling fan 5*b* and configured to transfer heat of a cooling liquid in the tube 4 into the air; heat receiving units 2 that are disposed to contact temperature-increasing parts 8 of the image forming apparatus so that the cooling liquid can receive heat from the temperature-increasing parts 8; a pump 1 used as a conveying unit for circulating the cooling liquid through the tube 4 between the radiation unit 5 and the heat receiving units 2; and a tank 3 used, for example, to supply the cooling liquid into the tube 4. The radiation unit 5 transfers the heat of the cooling liquid in the tube 4 into the air and thereby cools the cooling liquid. The cooled cooling liquid flows through the heat receiving units 2, receives heat from the temperature-increasing parts 8 (i.e., the cooling liquid is heated), and thereby cools the temperature-increasing parts 8. The cooling liquid heated at the heat receiving units 2 flows into the radiator 5*a* of the radiation unit 5 and the heat of the cooling liquid is transferred into the air (i.e., the cooling liquid is cooled) by the cooling fan 5*b*. Then, the cooled cooling liquid in the tube 4 is conveyed by the pump 1 to the heat receiving units 2 again. The radiator 5*a* of the radiation unit 5 includes a flow path formed in a highly thermal-conductive material, and fins made of a highly thermal-conductive material and connected to the flow path. The flow path and the fins are cooled by generating forced-convection heat transfer with the cooling fan 5*b* and thereby to cool the cooling liquid flowing through the flow path. Assuming that water is used as the cooling liquid, the specific heat capacity at constant volume of water is 3000 times greater than that of air. This indicates that a small amount of water can transfer a large amount of heat and a liquid-cooling device has higher cooling efficiency than an air-cooling device.

Examples of the temperature-increasing parts 8 of the image forming apparatus include the scanner 300, the exposing unit 31, the fusing unit 60, and the developing units 70. In the scanner 300, for example, the light source of the first moving unit 303 and a motor (not shown) for driving the first moving unit 303 and the second moving unit 304 generate heat. In the exposing unit 31, for example, a motor (not shown) for rotating a polygon mirror at high speed generates heat. In the developing unit 70, for example, the temperature is increased by frictional heat generated when the developer is agitated to charge the toner. In the fusing unit 60, for example, a heater used to fuse the toner image generates heat and the generated heat increases the temperature in and around the fusing unit 60. Also, the fusing process increases the temperature of a recording medium (paper P) and the recording medium in turn increases the temperature in a downstream component such as the reversing unit 28.

First Embodiment

Figure 1A:
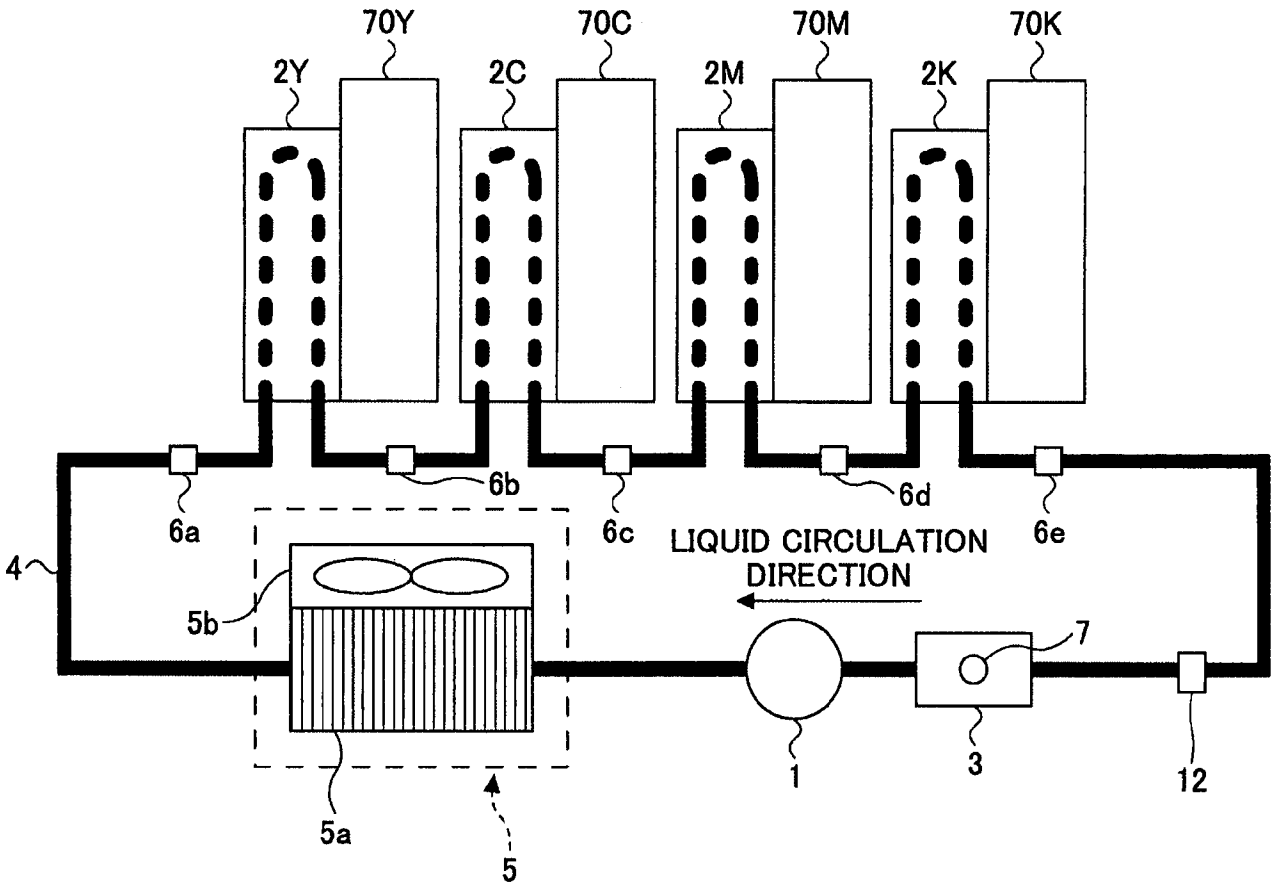
FIG. 1A is a top view of a cooling device according to a first embodiment of the present invention.
Figure 1B:
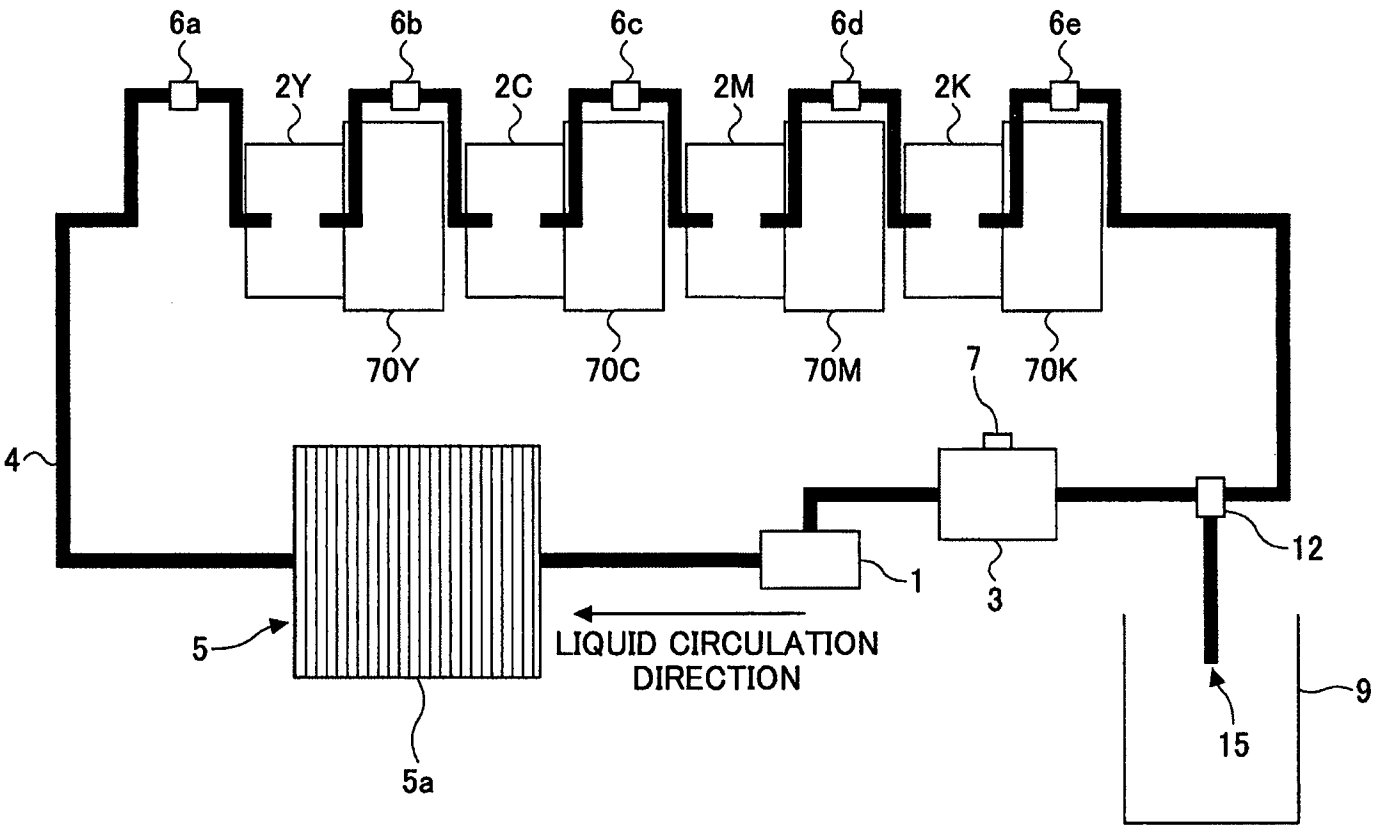
FIG. 1B is an elevational view of the cooling device of the first embodiment.

FIG. 1A is a top view of a cooling device 10 according to a first embodiment of the present invention, and FIG. 1B is an elevational view of the cooling device 10 (seen from the front side of the image forming apparatus shown in FIG. 2).

In this embodiment, it is assumed that heat receiving units 2Y, 2C, 2M, and 2K made of aluminum are provided to cool the developer in the developing units 70Y, 70C, 70M, and 70K. Each of the heat receiving units 2Y, 2C, 2M, and 2K has an internal flow path for the cooling liquid and is in contact with a side of the corresponding one of the developing units 70Y, 70C, 70M, and 70K.

The pump 1, the heat receiving units 2Y, 2C, 2M, and 2K, the tank 3, and the radiation unit 5 of the cooling device 10 are connected via the tube 4. The pump 1 circulates the cooling liquid through the tube 4 in a liquid circulation direction indicated by an arrow shown in FIG. 1A. The tube 4 can be separated into multiple parts at positions before and after the respective heat receiving units 2Y, 2C, 2M, and 2K. The parts of the tube 4 are connected by five couplings 6*a*, 6*b*, 6*c*, 6*d*, and 6*e* (may be called coupling 6 or couplings 6 when distinction is not necessary). Each of the couplings 6 has an internal flow path. A three-way valve 12 is interposed in the tube 4 at a position upstream of the tank 3 in the liquid circulation direction. The three-way valve 12 switches flow directions of the cooling liquid flowing from the heat receiving units 2 and thereby causes the cooling liquid to flow into the tank 3 or a waste liquid tank 9.

The cooling liquid, for example, includes water as a main component. Also, propylene glycol or ethylene glycol may be added to water to lower the freezing temperature. Further, antirust (e.g., a phosphate substance, potassium phosphate salt, or inorganic potassium salt) may be added to prevent corrosion of metal that is in contact with the cooling liquid.

The tank 3 is, for example, made of polypropylene. The volume of the tank 3 is determined, for example, such that the tank 3 can contain an amount of the cooling liquid that is sufficient to prevent the concentration of propylene glycol in the cooling liquid from becoming greater than or equal to a predetermined level even if an amount of water that is supposed to penetrate through the tube 4 during an assumed service life is lost.

Figure 1C:
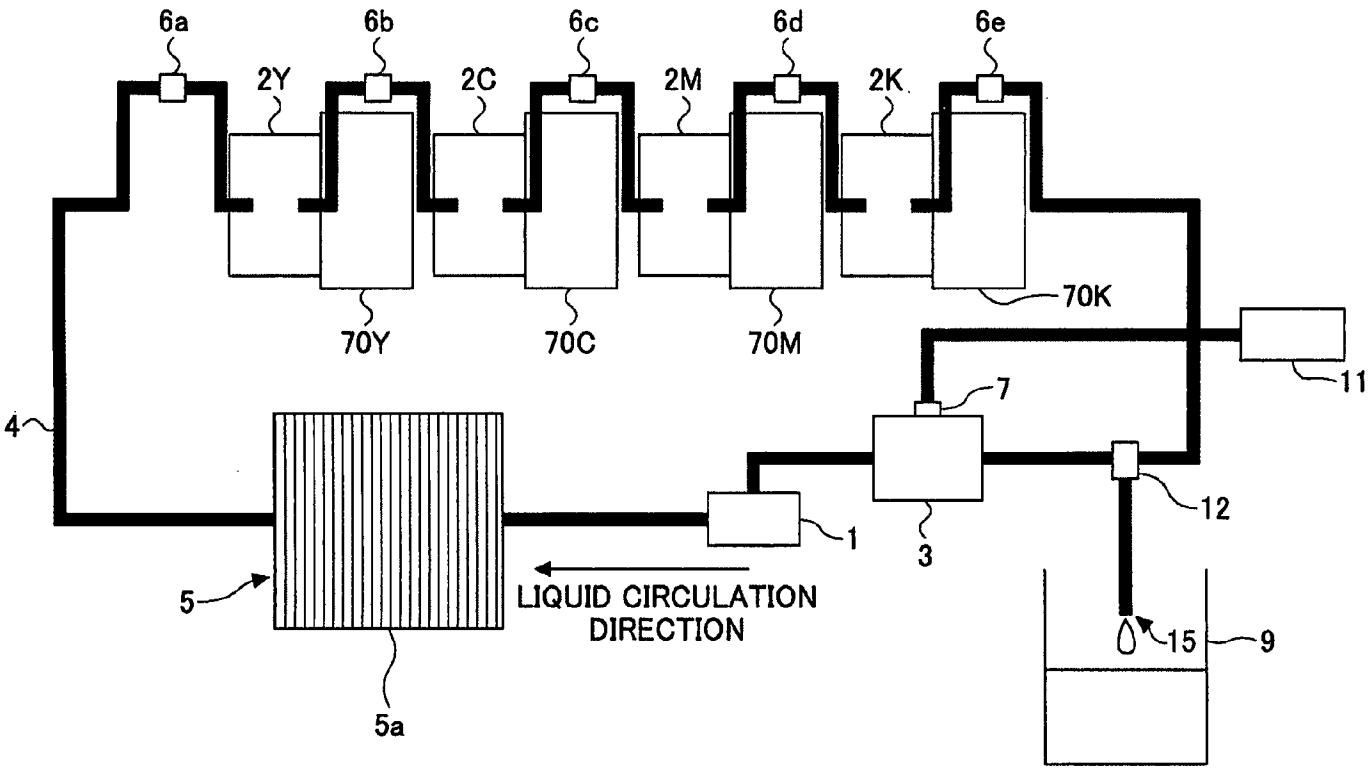
FIG. 1C is an elevational view of the cooling device where a coupler provided on top of a tank is connected to an air supply pump.

A coupler 7 is provided on top of the tank 3. As shown in FIG. 1C, the coupler 7 is connectable to an air supply pump 11.

The radiation unit 5 includes the radiator 5*a* that includes a corrugated fin structure made of aluminum and having an internal flow path for the cooling liquid; and the cooling fan 5*b* that is an axial fan. The cooling fan 5*b* blows air to the radiator 5*a* to transfer heat from the radiator 5*a* into the air and thereby to cool the cooling liquid flowing through the internal flow path of the radiator 5*a*.

The couplings 6*a*, 6*b*, 6*c*, 6*d*, and 6*e* do not include shutters for blocking the flow path. If the tube 4 is separated into parts at the couplings 6*a*, 6*b*, 6*c*, 6*d*, and 6*e*, the inside of the tube 4 communicates with the outside. The coupling 6 is configured to be inserted into the tube 4 such that the inner surface of the tube 4 contacts the outer surface of the coupling 6. Alternatively, a valveless coupler may be used as the coupling 6 to improve operational efficiency.

Figure 4A:
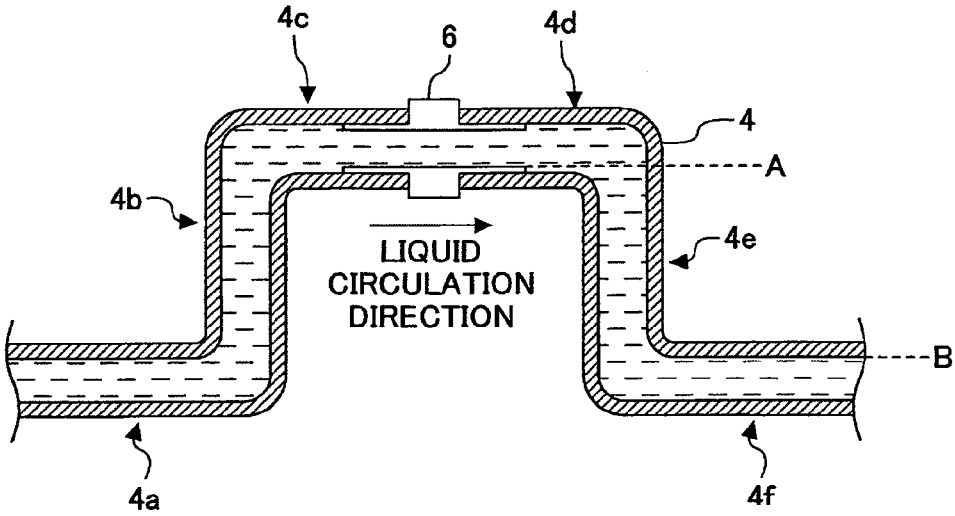
FIG. 4A is an enlarged elevational view of a coupling and a part of a tube that are filled with a cooling liquid.

FIG. 4A is an enlarged elevational view of the coupling 6 and a part of the tube 4 that are filled with the cooling liquid. As shown in FIG. 4A, a part of the tube 4 situated upstream of the coupling 6 in the liquid circulation direction includes a horizontal flow path 4*a* located at a position lower than the position of the coupling 6 and extending in a substantially horizontal direction; a vertical flow path 4*b* extending substantially vertically upward from a downstream end of the horizontal flow path 4*a*; and a horizontal flow path 4*c* extending from a downstream end of the vertical flow path 4*b* in a substantially horizontal direction and connected to an upstream end of the coupling 6. In this embodiment, "substantially horizontal direction" indicates a direction within ±5 degrees from the horizontal direction (0 degrees), and "substantially vertical direction" indicates a direction at an angle between 85 degrees and 95 degrees. Another part of the tube 4 situated downstream of the coupling 6 in the liquid circulation direction includes a horizontal flow path 4*d* connected to a downstream end of the coupling 6 and extending in a substantially horizontal direction; a vertical flow path 4*e* extending substantially vertically downward from a downstream end of the horizontal flow path 4*d*; and a horizontal flow path 4*f* extending in a substantially horizontal direction from a downstream end of the vertical flow path 4*e*.

When, for example, removing the cooling device 10 from the image forming apparatus for repair or maintenance or replacing a component (e.g., the pump 1, the heat receiving unit 2, the tank 3, or the radiation unit 5) of the cooling device 10, the tube 4 is separated into parts by disconnecting the couplings 6 from the tube 4. Here, if the tube 4 is filled with the cooling liquid when separating the tube 4 into parts, a large amount of the cooling liquid spills out of the tube 4 and wets the interior of the image forming apparatus and the floor. To prevent the cooling liquid from spilling out of the tube 4, the cooling liquid is drained from the tube 4 before separating the tube 4 into parts.

In this embodiment, when cooling the heat receiving units 2, a port of the three-way valve 12 leading to the tank 3 is opened to allow the cooling liquid from the heat receiving units 2 to flow into the tank 3. Meanwhile, when draining the cooling liquid from the tube 4, a port of the three-way valve 12 leading to the waste liquid tank 9 is opened to allow the cooling liquid from the heat receiving units 2 to flow via an outlet 15 into the waste liquid tank 9.

Figure 4B:
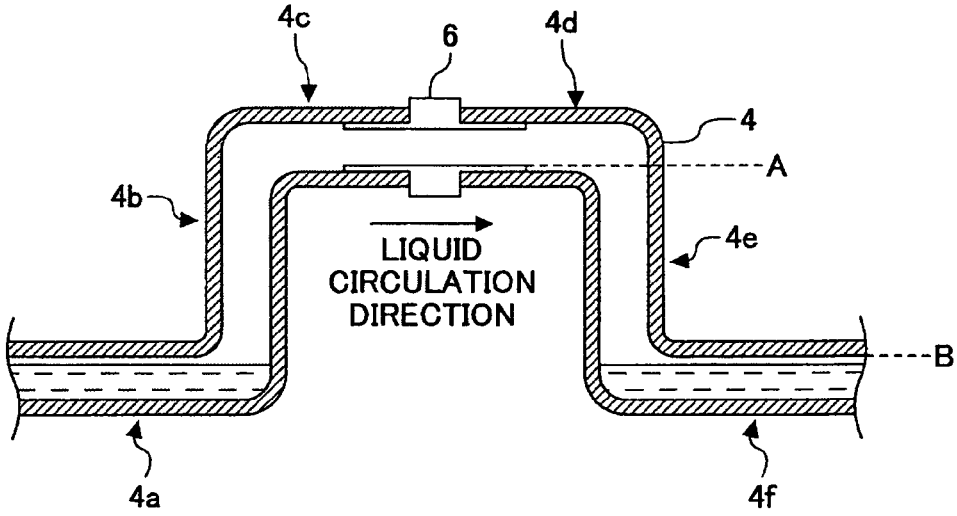
FIG. 4B is an enlarged elevational view of a coupling and a part of a tube where a space allowing air flow is generated.

After opening the port of the three-way valve 12 leading to the waste liquid tank 9, the coupler 7 on the tank 3 is connected to the air supply pump 11 to supply air from the air supply pump 11 via the tank 3 into the tube 4. The supplied air pushes the cooling liquid out of the tube 4 and causes the cooling liquid to flow via the outlet 15 into the waste liquid tank 9. After a while, a space allowing air flow is generated throughout the tube 4 as shown in FIG. 4B and it becomes impossible to push out the cooling liquid from the tube 4 by supplying air into the tube 4. As a result, as shown in FIG. 4B, the cooling liquid remains in lower parts (e.g., the horizontal flow path 4*a* and the horizontal flow path 4*f*) of the tube 4.

In this embodiment, the lower surface (indicated by "A" in FIGS. 4A and 4B) of the internal flow path of the coupling 6 is at a higher position than the upper surfaces (indicated by "B" in FIGS. 4A and 4B) of the horizontal flow paths 4*a* and 4*f* of the tube 4. Therefore, when a space allowing air flow is generated in the tube 4 as shown in FIG. 4B, the coupling 6 is inevitably above the surface of the cooling liquid in the horizontal flow paths 4*a* and 4*f* of the tube 4. Accordingly, even if the cooling liquid is not completely drained from the tube 4 and remains in the horizontal flow paths 4*a* and 4*f* of the tube 4 as shown in FIG. 4B, the cooling liquid does not remain in the coupling 6. This configuration makes it possible to minimize the amount of the cooling liquid that spills out of the tube 4 when the tube 4 is separated into parts at the coupling 6. Also in this embodiment, as shown in FIG. 1B, parts (flow paths) of the tube 4 extending to positions lower than the connecting points between the tube 4 and the couplings 6 are connected to the heat receiving units 2, and the heat receiving parts 2 are fixed to the image forming apparatus so as not to move in the height direction. This configuration prevents movement in the height direction of lower parts of the tube 4 where the cooling liquid tends to remain and thereby makes it possible to prevent the remaining cooling liquid from spilling out of the tube 4 when the tube 4 is separated into parts.

Figure 5A:
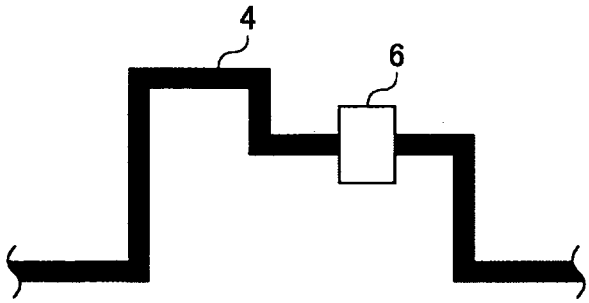
FIG. 5A is a drawing illustrating an exemplary layout of a tube before and after a coupling.
Figure 5B:
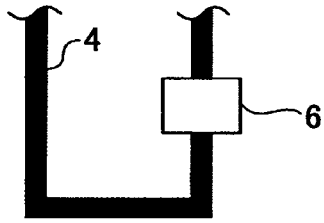
FIG. 5B is a drawing illustrating an exemplary layout of a tube before and after a coupling.

Although all the couplings 6 are positioned at the same height in this embodiment, the couplings 6 are not necessarily positioned at the same height. As a variation of this embodiment, as shown in FIGS. 5A and 5B, the cooling device 10 may be configured such that at least one of the parts of the tube 4 before and after the coupling 6 is located at a position lower than the position of the coupling 6. This configuration also makes it possible to prevent the cooling liquid from remaining in the coupling 6 even when the cooling liquid is not completely drained from the tube 4 and thereby makes it possible to minimize the amount of cooling liquid spilling out of the tube 4 when the tube 4 is separated into parts at the coupling 6. With the configuration of FIG. 5B, however, since the coupling 6 is interposed in a part (flow path) of the tube 4 extending vertically or at a steep angle and it is difficult to completely remove (or dry) the cooling liquid on the inner surface of the coupling 6, the cooling liquid may drip off when the coupling 6 is disconnected. Therefore, configurations as shown in FIGS. 4A, 4B, and 5A where the coupling 6 is interposed in a part (flow path) of the tube 4 extending in a substantially horizontal direction are more preferable than the configuration of FIG. 5B.

Figure 5C:
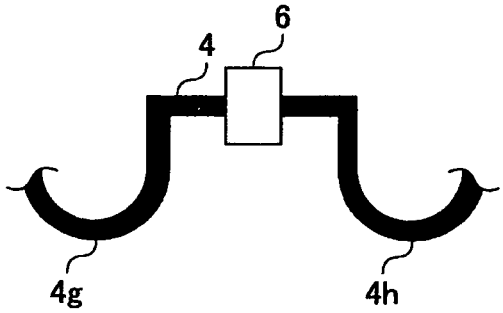
FIG. 5C is a drawing illustrating an exemplary layout of a tube where parts of the tube before and after a coupling have a curved shape.

As another variation of this embodiment, as shown in FIG. 5C, parts of the tube 4 extending to positions lower than the position of the coupling 6 may be formed as curved flow paths 4*g* and 4*h* instead of horizontal flow paths. Also with this configuration, when a space allowing air flow is generated in the tube 4, the coupling 6 is inevitably above the surface of the cooling liquid in the curved flow paths 4*g* and 4*h* of the tube 4. Accordingly, even if the cooling liquid is not completely drained from the tube 4 and remains in the curved flow paths 4*g* and 4*h* of the tube 4, the cooling liquid does not remain in the coupling 6. This in turn makes it possible to minimize the amount of the cooling liquid that spills out of the tube 4 when the tube 4 is separated into parts at the coupling 6.

As a comparative example, it is possible to use a coupler with a shutter (non-spill coupler) instead of the coupling 6. A coupler with a shutter can close the flow path when separating the tube 4 into parts and prevent the cooling liquid from spilling out of the tube 4. However, a coupler with a shutter is expensive and therefore increases the costs of an image forming apparatus. Using such an expensive coupler in preparation for repair or maintenance that is performed only a few times during the service life of an image forming apparatus is not cost effective.

As another comparative example, it is possible to pinch the tube 4 with forceps to close the flow path of the cooling liquid and then separate the tube 4 into parts above a waste cloth or a tray for receiving spilled cooling liquid. However, this method takes time and is inefficient. Also with this method, the forceps may come off while the tube 4 is being separated into parts and as a result, a large amount of the cooling liquid may spill out of the tube 4.

Configurations of this embodiment make it possible to minimize the amount of the cooling liquid spilling out of the tube 4 when the tube 4 is separated into parts as well as to prevent increase in the production costs.

In this embodiment, it is assumed that the developing units 70 are the temperature-increasing parts 8 to be cooled by the cooling device 10. However, as described above, the temperature-increasing parts 8 are not limited to the developing units 70.

Second Embodiment

Figure 6A:
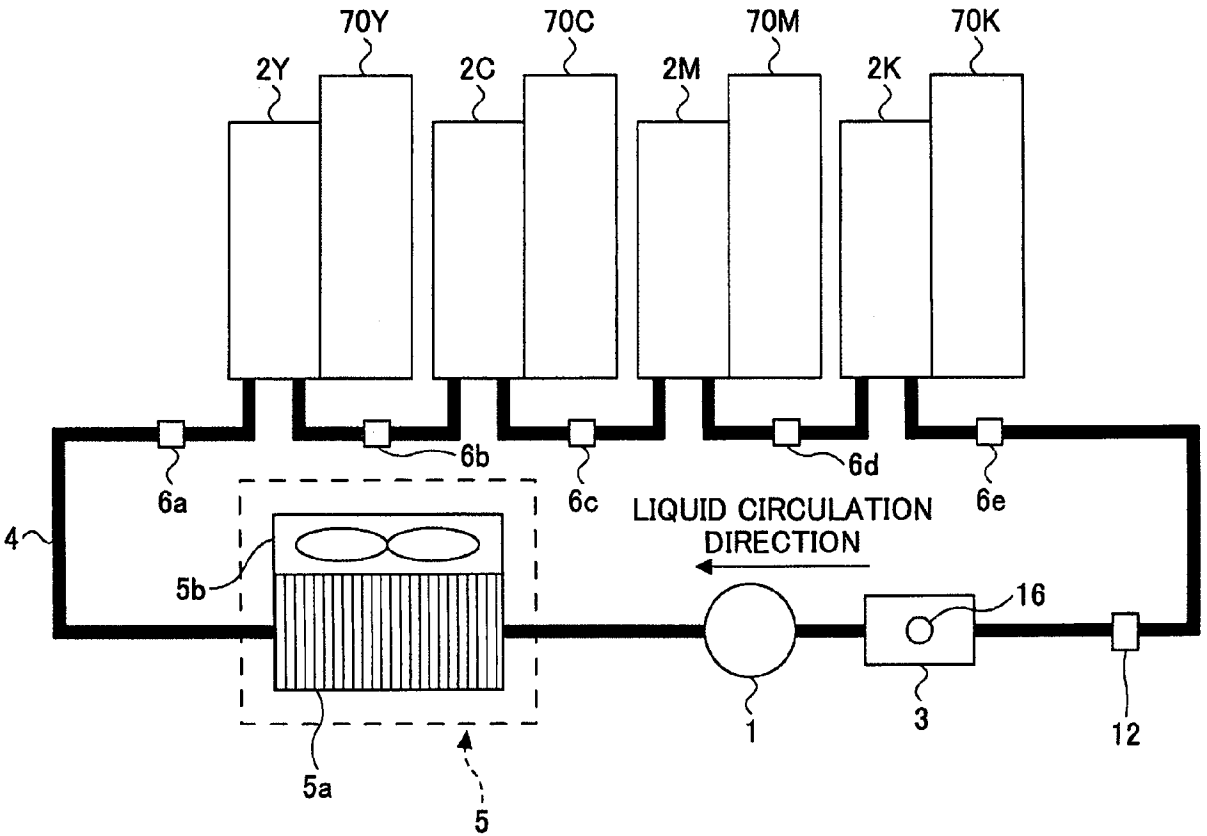
FIG. 6A is a top view of a cooling device according to a second embodiment of the present invention.
Figure 6B:
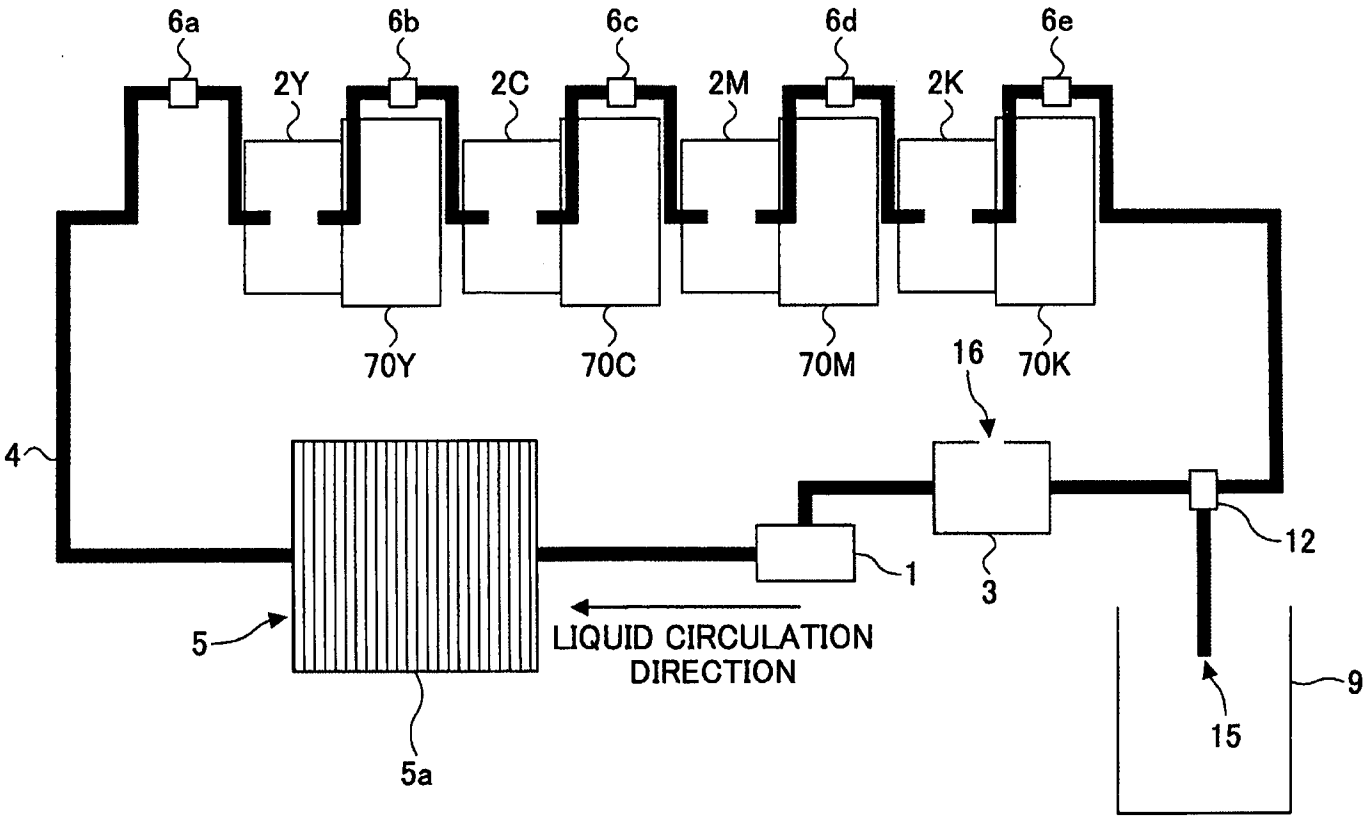
FIG. 6B is an elevational view of the cooling device of the second embodiment.

FIG. 6A is a top view of a cooling device 10 according to a second embodiment of the present invention, and FIG. 6B is an elevational view of the cooling device 10 (seen from the front side of the image forming apparatus shown in FIG. 2).

The cooling device 10 of the second embodiment is different from the cooling device 10 of the first embodiment in that the pump 1 is implemented by a self-priming pump and an air vent 16 communicating with the outside is formed in a wall of the tank 3 instead of the coupler 7 of the first embodiment. The air vent 16 is formed in a wall of the tank 3 at a position corresponding to the position of the coupler 7 of the first embodiment.

A self-priming pump is typically a pump that can suction a fluid and is able to discharge air mixed in the cooling liquid. In this embodiment, PPLP-03060-001 of Shinano Kenshi Co., Ltd. is used as the pump 1. PPLP-03060-001 can also be used to supply air for a short period of time to drain the cooling liquid.

Similarly to the first embodiment, when draining the cooling liquid from the tube 4, a port of the three-way valve 12 leading to the waste liquid tank 9 is opened to allow the cooling liquid from the heat receiving units 2 to flow via the outlet 15 into the waste liquid tank 9. Then, the pump 1 is driven to convey the cooling liquid. When the amount of the cooling liquid in the tank 3 becomes small, air flowing into the tank 3 via the air vent 16 is supplied by the pump 1 into the tube 4. The supplied air pushes the cooling liquid out of the tube 4 and causes the cooling liquid to flow via the outlet 15 into the waste liquid tank 9.

As in the first embodiment, when a space allowing air flow is generated throughout the tube 4, it becomes impossible to push out the cooling liquid from the tube 4 by supplying air into the tube 4. However, since the coupling 6 is at a higher position than the parts of the tube 4 located upstream and downstream of the coupling 6 in the liquid circulation direction as shown in FIG. 6B, the connecting points between the tube 4 and the coupling 6 are inevitably above the surface of the cooling liquid when a space allowing air flow is generated in the tube 4. Accordingly, even if the cooling liquid is not completely drained from the tube 4, the cooling liquid does not remain in the coupling 6 and at the connecting points between the coupling 6 and the tube 4. This in turn makes it possible to minimize the amount of the cooling liquid that spills out of the tube 4 when the tube 4 is separated into parts at the coupling 6.

A screw cap (opening/closing part) for opening and closing the air vent 16 of the tank 3 may be provided. When not draining the cooling liquid, the air vent 16 may be closed by the cap to prevent the cooling liquid in the tank 3 from being contaminated by dust and other foreign substances.

Third Embodiment

It is time consuming to fill the internal flow path of the radiator 5*a* with the cooling liquid. Therefore, when it is not necessary to remove the radiator 5*a* from the image forming apparatus, it is preferable not to drain the cooling liquid from the internal flow path of the radiator 5*a*.

Figure 7A:
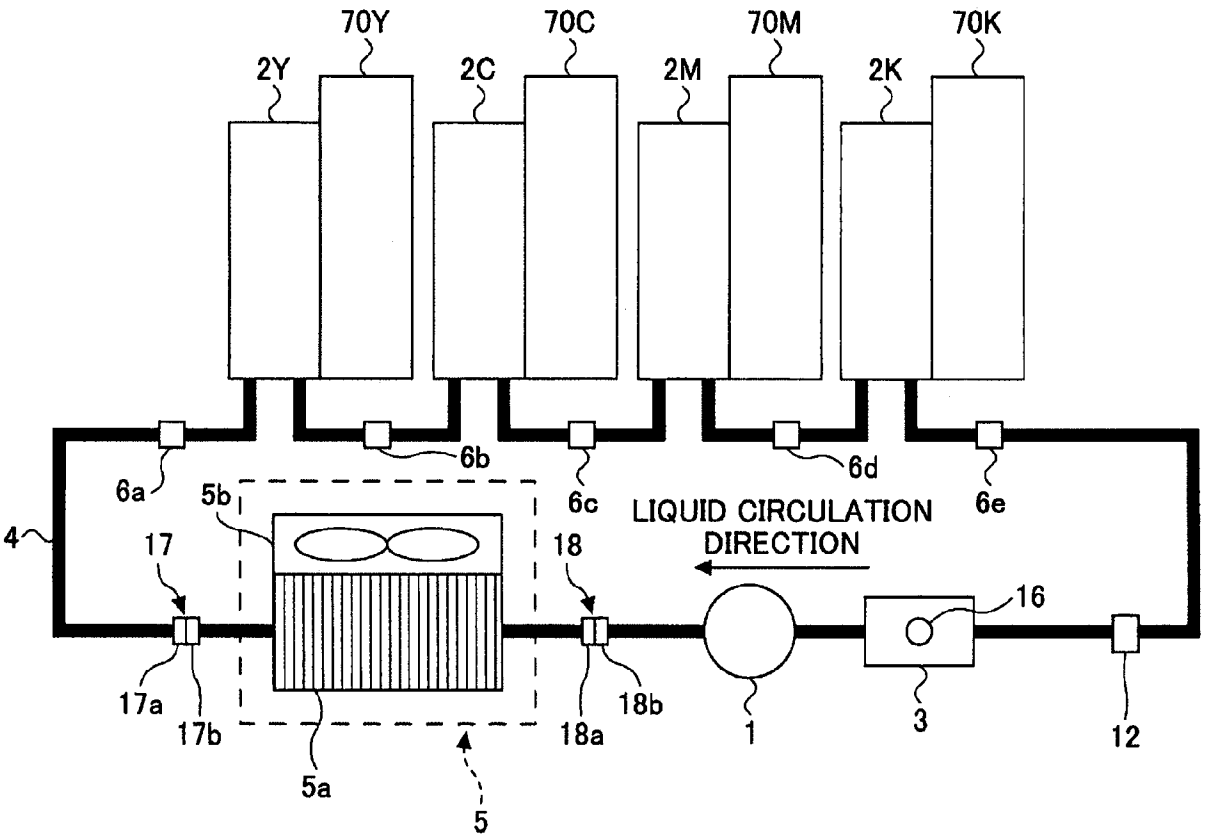
FIG. 7A is a top view of a cooling device according to a third embodiment of the present invention.
Figure 7B:
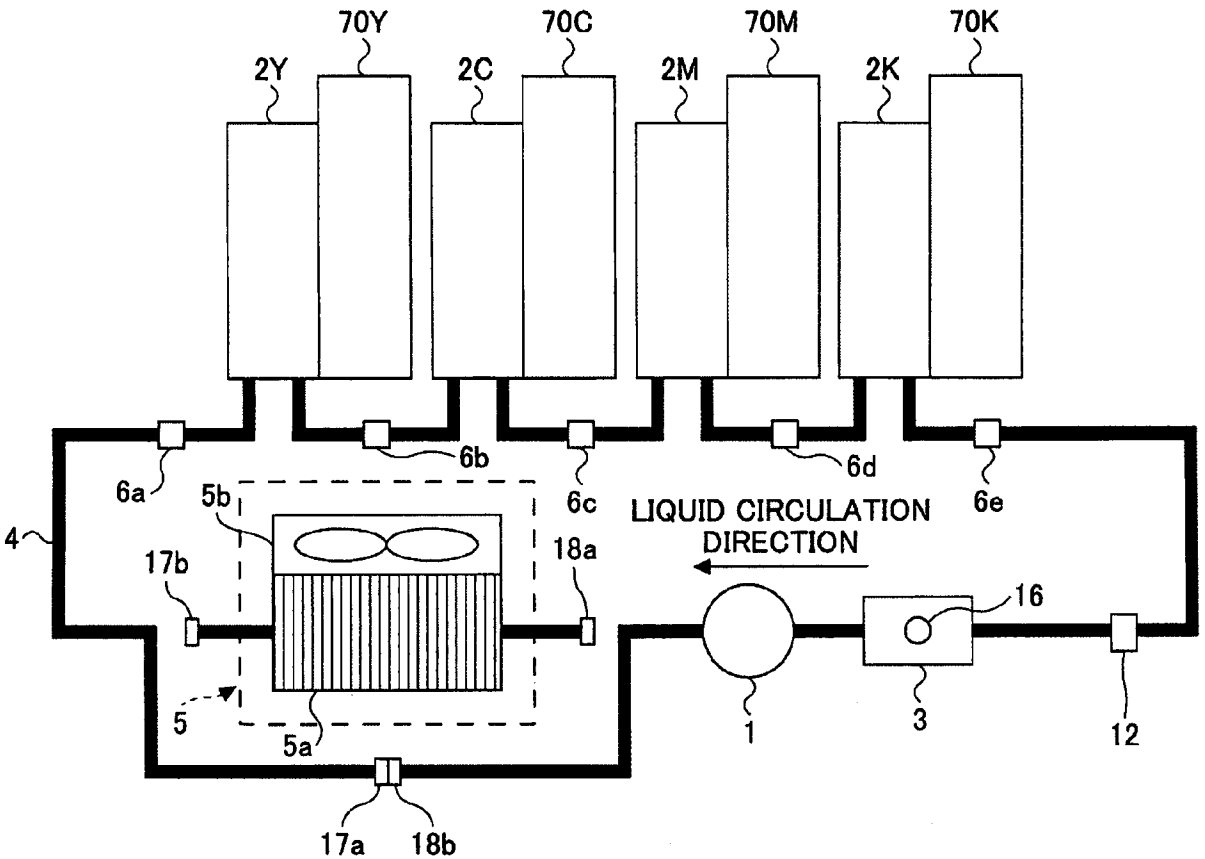
FIG. 7B is a top view of the cooling device of the third embodiment where parts of a tube before and after a radiator are directly connected.

FIGS. 7A and 7B show a cooling device 10 of a third embodiment of the present invention. The cooling device 10 of the third embodiment includes couplers 17 and 18 that include valves for closing the flow path and are attached to parts of the tube 4 connected to the upstream and downstream sides of the radiator 5*a* in the liquid circulation direction. The coupler 17 includes a plug 17*a* and a socket 17*b* that can be disconnected from each other; the coupler 18 includes a plug 18*a* and a socket 18*b* that can be disconnected from each other; and the parts of the tube 4 connected to the radiator 5*a* have extra lengths. With this configuration, the tube 4 can be separated at the coupler 17 and the coupler 18, and the socket 18*b* attached to the part of the tube 4 connected to the pump 1 and the plug 17*a* attached to the part of the tube 4 connected to the heat receiving unit 2Y for cooling the developing unit 70Y can be connected to each other.

In this embodiment, after the part of the tube 4 located upstream of the radiator 5*a* is connected to the part of the tube 4 located downstream of the radiator 5*a* via the plug 17*a* and the socket 18*b*, the cooling liquid is drained from the tube 4 into the waste liquid tank 9 in a manner similar to the above embodiments. This configuration makes it possible to separate the tube 4 at the couplings 6 without draining the cooling liquid from the radiator 5*a*.

Fourth Embodiment

Figure 8:
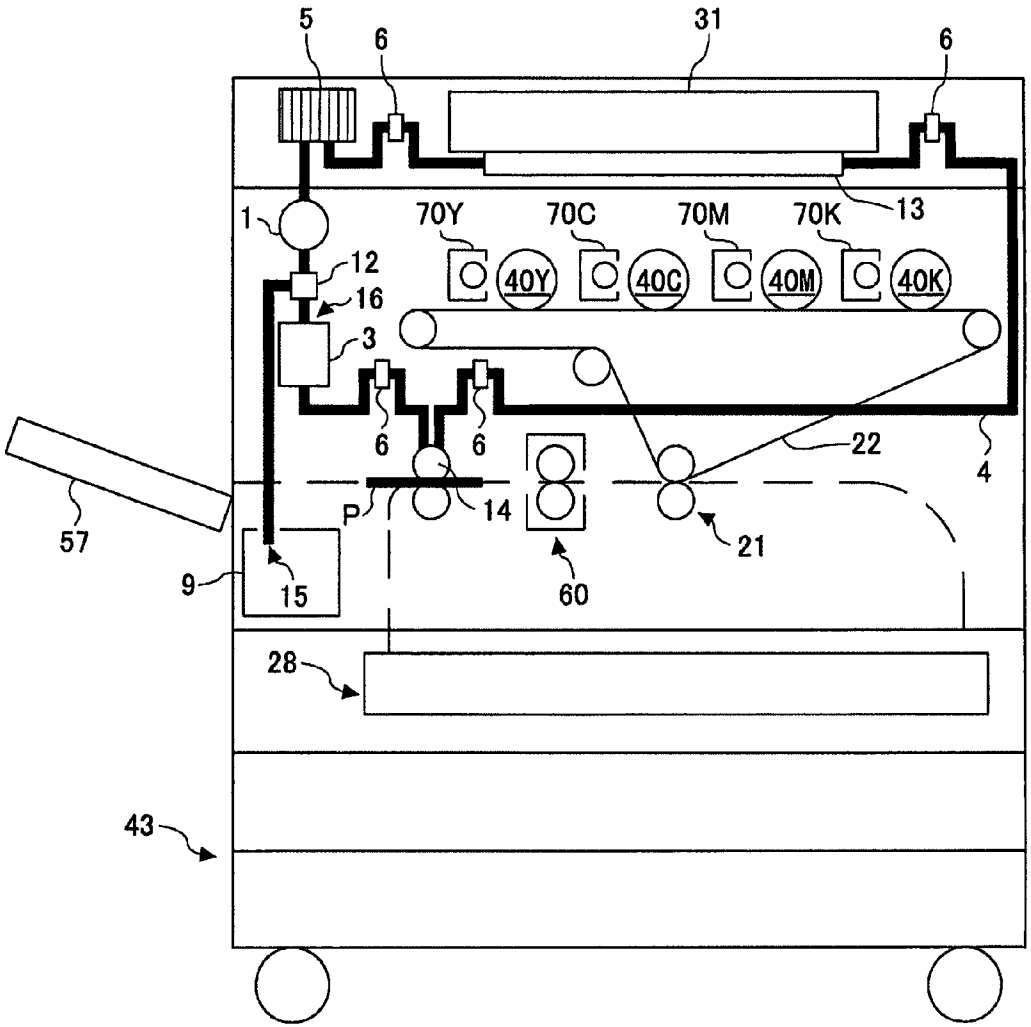
FIG. 8 is a schematic diagram of an image forming apparatus including a cooling device according to a fourth embodiment of the present invention.

FIG. 8 is a schematic diagram of an image forming apparatus including a cooling device 10 according to a fourth embodiment of the present invention. In the fourth embodiment, the cooling device 10 is configured to cool the exposing unit 31 and also to cool the paper P (not shown) after a toner image is fused onto the paper P.

The cooling device 10 of this embodiment includes a liquid-cooling jacket 13 disposed to contact the under surface of the exposing unit 31 and having an internal flow path, a cooling roller 14 disposed to contact the paper P that has passed through the fusing unit 60, a pump 1, a tank 3, a radiation unit 5, a three-way valve 12, a waste liquid tank 9, and a tube 4 connecting these components.

The cooling roller 14 has an internal flow path where the cooling liquid flows. Also, rotary joints are provided at ends in the axial direction of the cooling roller 14. The rotary joints are connected to the tube 4 so that the cooling liquid can flow into and out of the cooling roller 14 being rotated. The cooling roller 14 rotates and contacts the paper P being conveyed. Heat is transferred from the paper P to the cooling liquid flowing through the internal flow path of the cooling roller 14 and as a result, the paper P is cooled.

Couplings 6 are interposed in the tube 4 at positions upstream and downstream of the liquid-cooling jacket 13 and the cooling roller 14 such that the tube 4 can be separated into parts at the couplings 6. The couplings 6 are disposed at higher positions than the parts of the tube 4 located upstream and downstream of the respective couplings 6.

In this embodiment, the pump 1 is implemented by a self-priming pump and an air vent 16 is formed in a wall of the tank 3. The air vent 16 communicates with the outside and allows air to flow into and out of the tank 3. The tank 3 may have two or more air vents 16.

When draining the cooling liquid from the tube 4, a port of the three-way valve 12 leading to the waste liquid tank 9 is opened to allow the cooling liquid from the liquid-cooling jacket 13 and the cooling roller 14 to flow via the outlet 15 into the waste liquid tank 9. Then, the pump 1 is driven to convey the cooling liquid. When the amount of the cooling liquid in the tank 3 becomes small, air flowing into the tank 3 via the air vent 16 is supplied by the pump 1 into the tube 4. The supplied air pushes the cooling liquid out of the tube 4 and causes the cooling liquid to flow via the outlet 15 into the waste liquid tank 9.

When a space allowing air flow is generated throughout the tube 4, it becomes impossible to push out the cooling liquid from the tube 4 by supplying air into the tube 4. However, since the coupling 6 and the connecting points between the tube 4 and the coupling 6 are at higher positions than the parts of the tube 4 located upstream and downstream of the coupling 6 in the liquid circulation direction, the lower surface of the internal flow path of the coupling 6 is inevitably above the surface of the cooling liquid when a space allowing air flow is generated in the tube 4. Accordingly, even if the cooling liquid is not completely drained from the tube 4, the cooling liquid does not remain in the couplings 6 and at the connecting points between the couplings 6 and the tube 4. This in turn makes it possible to minimize the amount of the cooling liquid that spills out of the tube 4 when the tube 4 is separated into parts at the couplings 6.

In this embodiment, the cooling device 10 is configured to cool the exposing unit 31 and the paper P. However, the cooling, device 10 may be configured to cool other high-temperature parts of the image forming apparatus.

The radiation unit 5 may be replaced with a Peltier cooling device or a heat pump refrigerator. This configuration makes it possible to cool the cooling liquid to a temperature lower than the ambient temperature and thereby makes it possible to improve the cooling capability of the cooling device 10.

As described above, according to an embodiment of the present invention, a cooling device 10 includes a heat receiving unit 2 disposed to contact the surface of a temperature-increasing part 8 the temperature of which increases during an image forming process; a radiation unit 5 for transferring heat from a cooling liquid; a tube 4 for circulating the cooling liquid between the heat receiving unit 2 and the radiation unit 5 in a liquid circulation direction; a pump 1 used as a conveying unit for conveying the cooling liquid through the tube 4; a coupling 6 having an internal flow path and including a first end to which a first part of the tube 4 is connected and a second end to which a second part of the tube 4 is connected; and an outlet 15 for draining the cooling liquid from the tube 4. At least one of the first part of the tube 4 and the second part of the tube 4 extends to a position lower than the position of the coupling 6 (or the connecting points between the first and second parts of the tube 4 and the coupling 6). With this configuration, when the cooling liquid is drained from the tube 4 via the outlet 15, the cooling liquid in the coupling 6 (or at the connecting points) flows to a lower position than the coupling 6 (or the connecting points). Thus, this configuration makes it possible to prevent the cooling liquid from remaining in the coupling 6 (or at the connecting points). This in turn makes it possible to reduce the amount of the cooling liquid that spills out of the coupling 6 and the tube 4 when the tube 4 is disconnected from the coupling 6.

According to an embodiment of the present invention, the first end of the coupling 6 is an upstream end in the liquid circulation direction and the second end of the coupling 6 is a downstream end in the liquid circulation direction. The first part of the tube 4 connected to the first end of the coupling 6 may include a horizontal flow path 4*a* located at a position lower than the position of the coupling 6 (or the connecting points) and extending in a substantially horizontal direction; a vertical flow path 4*b* extending substantially vertically upward from a downstream end in the liquid circulation direction of the horizontal flow path 4*a*; and a horizontal flow path 4*c* extending in a substantially horizontal direction from a downstream end in the liquid circulation direction of the vertical flow path 4*b* and connected to the first end of the coupling 6. The second part of the tube 4 connected to the second end of the coupling 6 may include a horizontal flow path 4*d* connected to the second end of the coupling 6 and extending in a substantially horizontal direction; a vertical flow path 4*e* extending substantially vertically downward from a downstream end in the liquid circulation direction of the horizontal flow path 4*d*; and a horizontal flow path 4*f* extending in a substantially horizontal direction from a downstream end in the liquid circulation direction of the vertical flow path 4*e* and located at a position lower than the position of the coupling 6 (or the connecting points). With this configuration, the lower surface of the internal flow path of the coupling 6 is at a position higher than the position of the upper surface of the horizontal flow path 4*a* or the horizontal flow path 4*f*. Therefore, when a space allowing air flow is generated in the tube 4 during a process of draining the cooling liquid from the tube 4, the lower surface of the internal flow path of the coupling 6 is above the surface of the cooling liquid in the horizontal flow path 4*a* or the horizontal flow path 4*f*. Accordingly, even if the cooling liquid is not completely drained from the tube 4 and remains in the horizontal flow path 4*a* or the horizontal flow path 4*f*, the cooling liquid does not remain in the coupling 6. This in turn makes it possible to minimize the amount of the cooling liquid that spills out of the tube 4 when the tube 4 is separated into parts at the coupling 6.

According to an embodiment of the present invention, the cooling device 10 further includes a tank 3 connected to the tube 4 and used as a container for containing the cooling liquid to be conveyed through the tube 4; and a coupler 7 attached to the tank 3 and used as a connecting part connectable to an air supply pump 11 used as an air supplying unit for supplying air into the tube 4. When draining the cooling liquid from the tube 4, the coupler 7 is connected to the air supply pump 11 to supply air from the air supply pump 11 via the tank 3 into the tube 4. The supplied air pushes the cooling liquid out of the tube 4 and causes the cooling liquid to flow into a waste liquid tank 9.

According to an embodiment of the present invention, the pump 1 is a self-priming pump and at least one air vent 16 is formed in a wall of the tank 3 to allow air to flow into or out of the tank 3. With this configuration, when the cooling liquid in the tube 4 is drained via the outlet 15, air is drawn through the air vent 16 into the tank 3 and supplied into the tube 4, and the cooling liquid is pushed out of the tube 4 by the supplied air and caused to flow into the liquid waste tank 9. Thus, this configuration makes it possible to drain the cooling liquid from the tube 4 without using an external drive unit.

According to an embodiment of the present invention, the cooling device 10 further includes a cap used as an opening/closing part for opening and closing the air vent 16. The configuration makes it possible to close the air vent 16 when not draining the cooling liquid from the tube 4 and thereby makes it possible to prevent the cooling liquid in the tank 3 from being contaminated by dust and other foreign substances entering via the air vent 16, to prevent the cooling liquid from spilling out of the tank 3 through the air vent 16 when, for example, the tank 3 is shaken, and to prevent the cooling liquid from evaporating into the air through the air vent 16.

According to an embodiment of the present invention, the cooling device 10 further includes a plug 18*a* (first connecting part) provided at an upstream side in the liquid circulation direction of the radiation unit 5, a socket 18*b* (second connecting part) that is attached to a part of the tube 4 located upstream of the radiation unit 5 in the liquid circulation direction and connectable to and disconnectable from the plug 18*a*; a socket 17*b* (third connecting part) provided at a downstream side in the liquid circulation direction of the radiation unit 5; and a plug 17*a* (fourth connecting part) that is attached to a part of the tube 4 located downstream of the radiation unit 5 in the liquid circulation direction and connectable to and disconnectable from the socket 17*b*. The plug 17*a* is connectable to and disconnectable from the socket 18*b*. For example, when it is not necessary to remove the radiation unit 5 from the image forming apparatus, the part of the tube 4 located upstream of the radiation unit 5 is connected to the part of the tube 4 located downstream of the radiation unit 5 via the plug 17*a* and the socket 18*b* before draining the cooling liquid from the tube 4 via the outlet 15 into the waste liquid tank 9. This configuration makes it possible to separate the tube 4 into parts at the couplings 6 without draining the cooling liquid from the radiator 5*a*.

Still another embodiment of the present invention provides an image forming apparatus including the cooling device 10.

The present invention is not limited to the specifically disclosed embodiments, and variations and modifications may be made without departing from the scope of the present invention.

The present application is based on Japanese Priority Application No. 2010-001121 filed on Jan. 6, 2010 and Japanese Priority Application No. 2010-203951 filed on Sep. 13, 2010, the entire contents of which are hereby incorporated herein by reference.

What is claimed is:

1. A cooling device, comprising:

a heat receiving unit disposed to contact a surface of a temperature-increasing part a temperature of which increases during an image forming process;

a radiation unit transferring heat from a cooling liquid;

a tube for circulating the cooling liquid between the heat receiving unit and the radiation unit in a liquid circulation direction;

a conveying unit conveying the cooling liquid through the tube a coupling having an internal flow path and including a first end to which a first part of the tube is connected and a second end to which a second part of the tube is connected; and an outlet for draining the cooling liquid from the tube, wherein at least one of the first part of the tube and the second part of the tube extends to a position lower than a position of the coupling, when the first end of the coupling is an upstream end in the liquid circulation direction and the second end of the coupling is a downstream end in the liquid circulation direction, the first part of the tube connected to the first end of the coupling includes a first horizontal flow path located at a position lower than the position of the coupling and extending in a substantially horizontal direction, a first vertical flow path extending substantially vertically upward from a downstream end in the liquid circulation direction of the first horizontal flow path, and a second horizontal flow path extending in a substantially horizontal direction from a downstream end in the liquid circulation direction of the first vertical flow path and connected to the first end of the coupling; and the second part of the tube connected to the second end of the coupling includes a third horizontal flow path connected to the second end of the coupling and extending in a substantially horizontal direction;

a second vertical flow path extending substantially vertically downward from a downstream end in the liquid circulation direction of the third horizontal flow path, and a fourth horizontal flow path extending in a substantially horizontal direction from a downstream end in the liquid circulation direction of the second vertical flow path and located at a position lower than the position of the coupling.

2. A cooling device, comprising:

a heat receiving unit disposed to contact a surface of a temperature-increasing part a temperature of which increases during an image forming process;

a radiation unit transferring heat from a cooling liquid, a tube for circulating the cooling liquid between the heat receiving unit and the radiation unit in a liquid circulation direction;

a conveying unit conveying the cooling liquid through the tube;

a coupling having an internal flow path and including a first end to which a first part of the tube is connected and a second end to which a second part of the tube is connected;

an outlet for draining the cooling liquid from the tube;

a container connected to the tube and containing the cooling liquid to be conveyed through the tube; and a connecting part attached to the container and to be connected to an air supplying unit supplying air into the tube, wherein at least one of the first part of the tube and the second part of the tube extends to a position lower than a position of the coupling.

3. The cooling device as claimed in claim 1, further comprising:

a container connected to the tube and containing the cooling liquid to be conveyed through the tube, wherein the conveying unit is a self-priming pump; and at least one air vent for allowing air to flow into and out of the container is formed in a wall of the container.

4. The cooling device as claimed in claim 3, further comprising:

an opening/closing part for opening and closing the air vent.

5. A cooling device, comprising:

a heat receiving unit disposed to contact a surface of a temperature-increasing part a temperature of which increases during an image forming process;

a radiation unit transferring heat from a cooling liquid;

a tube for circulating the cooling liquid between the heat receiving unit and the radiation unit in a liquid circulation direction;

a conveying unit conveying the cooling liquid through the tube;

a coupling having an internal flow path and including a first end to which a first part of the tube is connected and a second end to which a second part of the tube is connected;

an outlet for draining the cooling liquid from the tube;

a first connecting part provided at an upstream side in the liquid circulation direction of the radiation unit;

a second connecting part that is attached to a part of the tube located upstream of the radiation unit in the liquid circulation direction and connectable to and disconnectable from the first connecting part;

a third connecting part provided at a downstream side in the liquid circulation direction of the radiation unit; and a fourth connecting part that is attached to a part of the tube located downstream of the radiation unit in the liquid circulation direction and connectable to and disconnectable from the third connecting part, wherein at least one of the first part of the tube and the second part of the tube extends to a position lower than a position of the coupling, and the second connecting part is connectable to and disconnectable from the fourth connecting part.

6. An image forming apparatus, comprising:

an image forming unit forming an image;

a temperature-increasing part a temperature of which increases during an image forming process; and the cooling device of claim 1 configured to cool the temperature-increasing part.

7. An image forming apparatus, comprising:

an image forming unit forming an image;

a temperature-increasing part a temperature of which increases during an image forming process; and the cooling device of claim 2 configured to cool the temperature-increasing part.

8. An image forming apparatus, comprising:

an image forming unit forming an image;

a temperature-increasing part a temperature of which increases during an image forming process; and the cooling device of claim 5 configured to cool the temperature-increasing part.

* * * * *